US006010988A

United States Patent [19]

Matsuoka et al.

[11] Patent Number: 6,010,988

[45] Date of Patent: Jan. 4, 2000

[54] LUBRICATING OIL COMPOSITION

[75] Inventors: Toru Matsuoka; Hisayuki Wada; Susumu Yoshida; Naozumi Arimoto, all of Kanagawa, Japan

[73] Assignee: Mitsubishi Oil Co., Ltd., tokyo, Japan

[21] Appl. No.: 09/152,308

[22] Filed: Sep. 14, 1998

[30] Foreign Application Priority Data

Oct. 9, 1997 [JP] Japan ..... 9-293372

[51] Int. Cl.[7] ..... C10M 141/10

[52] U.S. Cl. ..... 508/372; 508/378; 508/584; 508/585; 252/74; 252/75

[58] Field of Search ..... 508/372, 584, 508/585

[56] References Cited

U.S. PATENT DOCUMENTS

| | | | |
|---|---|---|---|
| 3,211,652 | 10/1965 | Hinkamp | 508/585 |
| 3,451,930 | 6/1969 | Mead | 508/372 |
| 3,816,544 | 6/1974 | Brindell et al. | 508/585 |
| 4,171,558 | 10/1979 | Igrashi et al. | 508/372 |
| 4,179,389 | 12/1979 | Mann | 508/372 |
| 4,528,108 | 7/1985 | Grover | 508/372 |
| 4,532,059 | 7/1985 | Rosenberger | 508/585 |
| 5,108,634 | 4/1992 | Seiki | 508/585 |
| 5,198,129 | 3/1993 | Hata | 508/372 |
| 5,262,073 | 11/1993 | Schmitt et al. | 508/372 |
| 5,328,620 | 7/1994 | Ripple | 508/372 |

*Primary Examiner*—Ellen M. McAvoy
*Attorney, Agent, or Firm*—Sughrue, Mion, Zinn, Macpeak & Seas, PLLC

[57] ABSTRACT

A lubricating oil composition for a wet clutch, particularly for an automatic transmission, which comprises mineral oil, synthetic oil or a mixture thereof as a base oil, and which contains 0.1 to 4.0% by weight of at least one compound selected from the group consisting of calcium sulfonate and calcium phenate, 0.1 to 0.5% by weight of zinc dithiophosphate, and 0.1 to 1.5% by weight of a bisphenol antioxidant, each based on the total weight of the lubricating oil composition. The composition has excellent initial anti-shudder properties, anti-shudder properties of long duration, and good thermal-oxidative stability.

9 Claims, No Drawings

LUBRICATING OIL COMPOSITION

FIELD OF THE INVENTION

This invention relates to a lubricating oil composition suitable for application to the wet clutch of an automatic transmission, construction machinery, agricultural machinery and the like. More particularly, the present invention relates to a lubricating oil composition for use in a torque converter lock-up clutch equipped with a slip control mechanism, which exhibits excellent anti-shudder properties from an initial stage, anti-shudder properties of long duration and good oxidative stability.

BACKGROUND OF THE INVENTION

Lubricating oil for use in a wet clutch of an automatic transmission, construction or agricultural machinery, etc., is required to have excellent thermal-oxidative stability, wear prevention properties and frictional characteristics suitable for a wet clutch. Lubricating oil standards for this use include the DEXRON III Standards by General Motors Corp. and MERCON Standards by the Ford Motor Co.

Lubricating oil meeting these standards comprises a base oil (such as a mineral oil and a synthetic oil) and various additives (such as antioxidants, detergent-dispersants, wear preventives, rust preventives, sequestering agents, friction coefficient modifiers, defoaming agents, colorants, seal swelling agents and viscosity index improvers). The lubricating oil generally contains a zinc type antioxidant-extreme pressure additive-wear preventive, such as a zinc dialkyldithiophosphate, in order to improve thermal-oxidative stability or wear prevention properties, or a phosphorus type extreme pressure additive-wear preventive, such as a phosphoric ester and a phosphorous ester, in order to enhance wear prevention properties.

In recent years, a lock-up clutch effective in improving fuel consumption has been incorporated into the automatic transmission of many automobiles. A lock-up clutch is used in a torque converter. However, because a conventional lock-up mechanism is not operated in a low speed region but only in a high speed region, torque transmission through the torque converter has been accompanied by a power transmission loss between the input rev count of the transmission and the output rev count of the engine in a low speed region, for example, at the time of starting a car. This has caused an increase in fuel consumption. For the purpose of reducing the power transmission loss and thereby improving fuel consumption, a slip control system has recently been introduced in which the lock-up mechanism works in a low speed region as well.

The problem is that the car body shudders as the slip controlled lock-up mechanism is engaged. Shuddering is liable to occur particularly when the coefficient of friction is reduced with an increase in slip speed. Therefore, there has been a demand for frictional characteristics wherein the coefficient of friction increases with an increase in slip speed.

However, because of the difficulty in obtaining satisfactory initial frictional characteristics, it is likely that new cars will encounter the problem of shuddering. In such a case, it has been a practice to previously impart sufficient slides to the lock-up clutch friction materials before delivery.

The automatic transmission of up-to-date automobiles must be light and compact for improving fuel consumption, but this tendency is accompanied by an increase in heat load. On the other hand, a torque converter lock-up clutch equipped with a slip control mechanism has been increasingly adopted for the same purpose.

SUMMARY OF THE INVENTION

It is therefore an object of the present invention to provide a lubricating oil composition for a torque converter lock-up clutch equipped with a slip control mechanism, which exhibits excellent anti-shudder properties of long duration from an initial stage and high oxidative stability.

The present inventors have studied the above described problems of the prior art in order to provide a lubricating oil composition having satisfactory frictional characteristics at a low slip speed from an initial stage. As a result, the present inventors have discovered that compounding a base oil with specific amounts of a specific metallic detergent-dispersant and zinc dithiophosphate produces a lubricating oil composition having excellent initial frictional characteristics. It has also been found that the addition of a bisphenol compound as an antioxidant brings about improvements in the duration of frictional characteristics and oxidative stability.

The present invention provides a lubricating oil composition which comprises mineral oil, synthetic oil or a mixture thereof as a base oil and contains (a) 0.1 to 4.0% by weight of at least one compound selected from the group consisting of calcium sulfonate and calcium phenate, (b) 0.1 to 0.5% by weight of zinc dithiophosphate, and (c) 0.1 to 1.5% by weight of a bisphenol antioxidant, each based on the total weight of the lubricating oil composition.

DETAILED DESCRIPTION OF THE INVENTION

The base oil of the lubricating oil composition is selected from mineral oil, synthetic oil or a mixture thereof. The mineral oil for use in this invention is preferably purified by solvent refining or hydrogenation. Wax is preferably removed from the mineral oil to improve low temperature flowability. The synthetic oil includes poly-α-olefin oligomers, polybutenes, diesters and polyol esters. Taking the solubility of additives into consideration, a mixture of mineral oil and synthetic oil or a mixture of different kinds of synthetic oil is preferred to a single kind of synthetic oil.

From the standpoint of lubricity and low-temperature flowability, the base oil preferably has a dynamic viscosity of 2.5 to 50.0 $mm^2$/sec, particularly 2.5 to 10.0 $mm^2$/sec, at 100° C. If necessary, various viscosity index improvers having a thickening effect can be added. The lubricating oil composition according to the present invention has a dynamic viscosity of 5 to 10 $mm^2$/sec at 100° C.

The lubricating oil composition of the invention contains a metallic detergent-dispersant selected from calcium sulfonate, calcium phenate and mixtures thereof. The addition amount of the metallic detergent-dispersant is 0.1 to 4.0% by weight, preferably 0.5 to 1.5% by weight, based on the total composition. If the amount is less than 0.1%, the initial frictional characteristics are insufficient. If the amount exceeds 4.0%, calcium salts resulting from decomposition of the detergent-dispersant tend to be deposited in machine gaps only to reduce the coefficient of friction.

Compared with these metallic detergent-dispersants, ashless detergent-dispersants, such as succinimide, benzylamine and succinic esters are not as effective.

The lubricating oil composition of the invention contains 0.1 to 0.5% by weight of zinc dithiophosphate based on the total composition. In order for zinc dithiophosphate to produce a synergistic effect with the metallic detergent-dispersant, the compounding ratio is limited to the above range. If the amount of zinc dithiophosphate is less than 0.1%, sufficient oxidation resistance effects and initial frictional characteristics are not exerted. If the amount exceeds 0.5%, the metal content resulting from decomposition tends to be deposited in machine gaps, resulting in a reduction in the coefficient of friction.

The lubricating oil composition of the invention can further contain one or more bisphenol antioxidants. The addition amount of the bisphenol antioxidant ranges from 0.1 to 1.5% by weight, preferably 0.1 to 0.8% by weight, based on the total composition. If the amount is less than 0.1%, the effect in improving thermal-oxidative stability is insufficient. If the amount is more than 1.5%, the solubility of other additives tends to be deteriorated.

Examples of useful bisphenol antioxidants include 4,4'-methylenebis(2,6-di-t-butylphenol), 4,4'-bis(2,6-di-t-butylphenol), 4,4'-bis(2-methyl-6-t-butylphenol), 2,2'-methylenebis(4-ethyl-6-t-butylphenol), 2,2'-methylenebis(4-methyl-6-t-butylphenol), 4,4'-butylidenebis(3-methyl-6-t-butylphenol), 4,4'-isopropylidenebis(2,6-di-t-butylphenol), 2,2'-methylenebis(4-methyl-6-nonylphenol), 2,2'-isobutylidenebis(4,6-dimethylphenol) and 2,2'-methylenebis(4-methyl-6-cyclohexylphenol).

As long as the effects of the present invention are not impaired, the lubricating oil composition of the invention can contain appropriate amounts of other additives so as to maintain the basic performance properties required of a lubricating oil for a wet clutch of an automatic transmission or construction or agricultural machinery. Useful additives include antioxidants other than the bisphenol compounds, dispersants, sequestering agents, defoaming agents, viscosity index improvers and the like. While any known compounds customarily employed in the art can be used with no particular restriction, some preferred examples are shown below.

Suitable antioxidants include phenol compounds, such as 2,6-di-t-butyl-p-cresol, 2,6-di-t-butylphenol, 2,6-di-t-butyl-α-dimethylamino-p-cresol and 4,4'-thiobis(6-t-butyl-o-cresol); amine compounds, such as diphenylamine, 4,4'-tetramethyldiaminodiphenylmethane, phenyl-α-naphthylamine, alkylphenyl-β-naphthylamines and phenothiazine; sulfur compounds, such as olefin sulfides, terpene sulfides, dialkyl sulfides and dialkyl disulfides; and dithiocarbamic acid salts, such as zinc dialkyldithiocarbamates.

Suitable dispersants include succinimide and benzylamine. Suitable sequestering agents include benzotriazole and thiadiazole.

Useful friction modifiers include higher fatty acids, such as oleic acid, stearic acid and palmitic acid; higher alcohols, such as lauryl alcohol, oleyl alcohol and cetyl alcohol; esters, such as ethyl oleate, sorbitan monostearate and glycerol monooleate; and amine compounds, such as cetylamine and octadecylamine.

Examples of useful defoaming agents are silicone compounds, such as dimethylsiloxane, phenylmethylsiloxane and cyclic organosiloxanes; and ester compounds, such as sorbitan monolaurate and alkenylsuccinic acid derivatives.

Suitable viscosity index improvers include polymethacrylate, polyisobutylene, an ethylene-propylene copolymer and a styrene-diester copolymer.

The lubricating oil composition of the present invention is especially suited for application to a torque converter lock-up clutch equipped with a slip control mechanism.

As described above, the lubricating oil composition of the invention comprises a specific metallic detergent-dispersant, zinc dithiophosphate and a bisphenol antioxidant in such a ratio so as to produce synergistic effects. Although the metallic detergent-dispersant shows excellent effects in preventing initial shudder, it adversely affects thermal oxidative-stability. The zinc dithiophosphate and bisphenol antioxidant suppress the adverse influence of the metallic detergent-dispersant without impairing the characteristics of the latter. Therefore, when applied to a wet clutch of an automatic transmission, construction machinery, agricultural machinery and the like, the lubricating oil composition of the present invention exerts its excellent effects on shudder from an initial stage, which effect has been difficult to achieve by conventional techniques. This makes it possible to use the clutch without requiring the previous sliding of friction materials and achieving an extension of the lubricity duration.

The present invention will now be illustrated in greater detail with reference to following Examples and Comparative Examples, but it should be understood that the present invention is not limited thereto.

EXAMPLES 1 TO 10 AND COMPARATIVE EXAMPLES 1 TO 9

Lubricating oil compositions were prepared by compounding mineral oil having a dynamic viscosity of 3.5 $mm^2$/sec (at 100° C.) as a base oil and additives in accordance with the formulations shown in Tables 1 and 2 below.

The resulting lubricating oil compositions were tested in accordance with the following methods. The results obtained are shown in Tables 1 and 2.

(1) Initial Anti-shudder Properties

A low-speed sliding friction tester was used. The coefficient of friction between a friction material SD-1777 (NSK-WARNER KABUSHIKI KAISHA) and a counter part (steel material) was measured at a sliding speed of 360 mm/sec ($\mu$360) and 720 mm/sec ($\mu$720) under the following conditions. A $\mu360/\mu720$ ratio was taken as a criterion for judging initial anti-shudder properties. The term "initial" as used herein means a state in which the friction material and the counter part have never been slid against each other before testing. If $\mu360/\mu720<1$, the lubricating oil composition is judged as having excellent initial anti-shudder properties.

Measuring Conditions:

Oil temperature: 80° C.

Amount of oil: 100 ml

Planar pressure: 10 kgf/$cm^2$ (2) Duration of Anti-shudder Properties

A durability test against continuous sliding was carried out with a low-speed sliding friction tester. Coefficients of friction were measured under the following conditions, and the time required for the $\mu360/\mu720$ ratio to exceed 1 was taken as the duration (life) of anti-shudder properties. The longer the time, the longer the shudder prevention life.

Measuring Conditions:

Friction material: SD-1777

Oil temperature: 1000° C.

Amount of oil: 100 ml

Planar pressure: 10 kgf/$cm^2$

Sliding speed: 720 mm/sec (3) Oxidative Stability

The lubricating oil composition was subjected to an "oxidation test of lubricating oil for an internal combustion engine" as specified in JIS K2514 to observe the increase in total acid number. An increase of 1.0 mgKOH/g or less was taken as an objective value. The test conditions were as follows.

Test Conditions:
Oil temperature: 165.5° C.
Amount of oil: 250 ml
Testing time: 72 hrs
Catalyst: copper, iron

TABLE 1

| | Example No. | | | | | | | | | |
|---|---|---|---|---|---|---|---|---|---|---|
| | 1 | 2 | 3 | 4 | 5 | 6 | 7 | 8 | 9 | 10 |
| Composition (wt %): | | | | | | | | | | |
| Base oil (mineral oil) | 87.6 | 86.3 | 84.8 | 85.3 | 86.3 | 86.5 | 86.2 | 86.5 | 85.8 | 86.3 |
| Basic Ca sulfonate | 0.2 | 1.5 | 3.0 | — | — | 1.5 | 1.5 | 1.5 | 1.5 | 1.5 |
| Neutral Ca sulfonate | — | — | — | — | — | — | — | — | — | — |
| Basic Ca phenate | — | — | — | 2.5 | 1.5 | — | — | — | — | — |
| Zn Dithiophosphate (primary, 2-ethylhexyl) | 0.3 | 0.3 | 0.3 | 0.3 | 0.3 | 0.1 | 0.4 | 0.3 | 0.3 | — |
| Zn Dithiophosphate (secondary) | — | — | — | — | — | — | — | — | — | 0.3 |
| 4,4'-Methylenebis(2,6-di-t-butylphenol) | 0.3 | 0.3 | 0.3 | 0.3 | 0.3 | 0.3 | 0.3 | 0.1 | 0.8 | 0.3 |
| Viscosity index improver | 6.0 | 6.0 | 6.0 | 6.0 | 6.0 | 6.0 | 6.0 | 6.0 | 6.0 | 6.0 |
| Other additives* | 5.6 | 5.6 | 5.6 | 5.6 | 5.6 | 5.6 | 5.6 | 5.6 | 5.6 | 5.6 |
| Total | 100 | 100 | 100 | 100 | 100 | 100 | 100 | 100 | 100 | 100 |
| Test Results: | | | | | | | | | | |
| Initial shudder prevention ($\mu$360/$\mu$1720) | 0.99 | 0.98 | 0.97 | 0.99 | 0.98 | 0.98 | 0.97 | 0.98 | 0.98 | 0.98 |
| Duration of Shudder prevention (hr) | 160 | 120 | 100 | 145 | 100 | 130 | 110 | 100 | 110 | 110 |
| Oxidative stability (increase in total acid number; mg KOH/g) | 0.6 | 0.8 | 0.9 | 0.7 | 0.8 | 1.0 | 0.7 | 1.0 | 0.7 | 1.0 |

Note:
*Antioxidant, ashless dispersant, extreme pressure additive, wear preventive, sequestering agent, etc.

TABLE 2

| | Comparative Example No. | | | | | | | | |
|---|---|---|---|---|---|---|---|---|---|
| | 1 | 2 | 3 | 4 | 5 | 6 | 7 | 8 | 9 |
| Composition (wt %): | | | | | | | | | |
| Base oil (mineral oil) | 87.75 | 87.75 | 87.75 | 82.8 | 86.59 | 86.0 | 86.6 | 84.6 | 87.8 |
| Basic Ca sulfonate | 0.05 | — | — | 5.0 | 1.5 | 1.5 | 1.5 | 1.5 | — |
| Neutral Ca sulfonate | — | 0.05 | — | — | — | — | — | — | — |
| Basic Ca phenate | — | — | 0.05 | — | — | — | — | — | — |
| Succinimide | — | — | — | — | — | — | — | — | 2.0 |
| Zn Dithiophosphate (primary 2-ethylhexyl) | 0.3 | 0.3 | 0.3 | 0.3 | 0.01 | 0.6 | 0.3 | 0.3 | 0.3 |
| Zn Dithiophosphate (secondary) | — | — | — | — | — | — | — | — | — |
| 4,4'-Methylenebis(2,6-di-t-butylphenol) | 0.3 | 0.3 | 0.3 | 0.3 | 0.3 | 0.3 | — | 2.0 | 0.3 |
| Viscosity index improver | 6.0 | 6.0 | 6.0 | 6.0 | 6.0 | 6.0 | 6.0 | 6.0 | 6.0 |
| Other additives* | 5.6 | 5.6 | 5.6 | 5.6 | 5.6 | 5.6 | 5.6 | 5.6 | 5.6 |
| Total | 100 | 100 | 100 | 100 | 100 | 100 | 100 | 100 | 100 |
| Test Results: | | | | | | | | | |
| Initial anti-shudder properties ($\mu$360/$\mu$720) | 1.01 | 1.05 | 1.01 | 0.97 | 0.99 | 0.97 | 0.97 | | 1.03 |
| Shudder prevention life (hr) | | | | 70 | 160 | 50 | 70 | | |
| Oxidative stability (increase in total acid number; mg KOH/g) | 0.6 | 0.6 | 0.6 | 1.4 | 1.3 | 0.8 | 3.5 | | 0.7 |

Note:
*Antioxidant, ashless dispersant, extreme pressure additive, wear preventive, sequestering agent, etc.

All of Examples 1 to 10 exhibited good results in initial anti-shudder properties, duration of shudder prevention and oxidative stability.

Comparative Examples 1 to 3 and 9 were, while satisfactory in oxidative stability, poorer than any of the Examples of the invention in initial anti-shudder properties, proving that the present effect in initial anti-shudder properties cannot be seen when the amount of the metallic detergent-dispersant is small and the use of an ashless detergent-dispersant in place of the metallic detergent-dispersant for use in the present invention is ineffective. Although Comparative Examples 4 and 7 exhibited excellent initial anti-shudder properties, the duration of anti-shudder properties was short, and the increase in total acid number in these Comparative Examples exceeded 1.0 mgKOH/g, being greater than that of any of the Examples of the invention. Comparative Example 5 was, while satisfactory in initial anti-shudder properties and duration of shudder prevention, inferior to the Examples of the invention in thermal-oxidative stability. Comparative Example 6 had a shorter shudder prevention life than any of the Examples of the invention. In Comparative Example 8, the additives did not dissolve so that the effects were not measurable.

In comparing Example 1 and Comparative Example 1 and in comparing Example 3 and Comparative Example 4, it is seen that the amount of the metallic detergent-dispersant for use in the present invention preferably ranges from 0.1 to 4.0% by weight. A comparison between Example 2 and Comparative Example 5 and between Example 7 and Comparative Example 6 verifies that the addition amount of zinc dithiophosphate preferably ranges from 0.1 to 0.5% by weight. Furthermore, a comparison between Example 8 and Comparative Example 7 and between Example 9 and Comparative Example 8 shows that the effective amount of the bisphenol antioxidant is in the range of from 0.1 to 1.5% by weight.

While the invention has been described in detail and with reference to specific examples thereof, it will be apparent to one skilled in the art that various changes and modifications can be made therein without departing from the spirit and scope thereof.

What is claimed is:

1. A lubricating oil composition which comprises mineral oil, synthetic oil or a mixture thereof as a base oil and which contains 0.1 to 4.0% by weight of at least one compound selected from the group consisting of calcium sulfonate and calcium phenate, 0.1 to 0.5% by weight of zinc dithiophosphate and 0.1 to 1.5% by weight of a bisphenol antioxidant, each based on the total weight of the lubricating oil composition.

2. The lubricating oil composition according to claim 1, wherein the composition is for use in a torque converter lock-up clutch equipped with a slip control mechanism.

3. The lubricating oil composition according to claim 1, having a dynamic viscosity of 5 to 10 $mm^2$/sec at 100° C.

4. The lubricating oil composition according to claim 1, containing 0.5 to 1.5% by weight of at least one compound selected from the group consisting of calcium sulfonate and calcium phenate.

5. The lubricating oil composition according to claim 1, containing from 0.1 to 0.8% by weight of a bisphenol antioxidant.

6. A method for lubricating a torque converter lock-up clutch with a slip control mechanism, which comprises applying a lubricating oil composition to the torque converter lock-up clutch equipped with a slip control mechanism, which lubricating oil composition comprises mineral oil, synthetic oil or a mixture thereof as a base oil and which contains 0.1 to 4.0% by weight of at least one compound selected from the group consisting of calcium sulfonate and calcium phenate, 0.1 to 0.5% by weight of zinc dithiophosphate and 0.1 to 1.5% by weight of a bisphenol antioxidant, each based on the total weight of the lubricating oil composition.

7. The method as claimed in claim 6, wherein the lubricating oil composition has a dynamic viscosity of 5 to 10 $mm^2$/sec at 100° C.

8. The method as claimed in claim 6, wherein the lubricating oil composition contains 0.5 to 1.5% by weight of at least one compound selected from the group consisting of calcium sulfonate and calcium phenate.

9. The method as claimed in claim 6, wherein the lubricating oil composition contains from 0.1 to 0.8% by weight of a bisphenol antioxidant.

* * * * *